US006900625B2

(12) United States Patent
Chevallier et al.

(10) Patent No.: US 6,900,625 B2
(45) Date of Patent: May 31, 2005

(54) VOLTAGE CONVERTER SYSTEM AND METHOD HAVING A STABLE OUTPUT VOLTAGE

(75) Inventors: Christophe J. Chevallier, Palo Alto, CA (US); Dumitru Cioaca, Cupertino, CA (US)

(73) Assignee: Micron Technology, Inc., Boise, ID (US)

( * ) Notice: Subject to any disclaimer, the term of this patent is extended or adjusted under 35 U.S.C. 154(b) by 145 days.

(21) Appl. No.: 10/388,058

(22) Filed: Mar. 12, 2003

(65) Prior Publication Data

US 2003/0169610 A1 Sep. 11, 2003

Related U.S. Application Data

(62) Division of application No. 10/076,982, filed on Feb. 15, 2002, now Pat. No. 6,593,726.

(51) Int. Cl.[7] ..... G08B 21/00; G05F 1/44

(52) U.S. Cl. ..... 323/284; 340/661; 340/664

(58) Field of Search ..... 323/273, 274, 323/282, 284; 340/660, 661, 664

(56) References Cited

U.S. PATENT DOCUMENTS

| | | | | | |
|---|---|---|---|---|---|
| 3,959,713 | A | | 5/1976 | Davis et al. | 323/278 |
| 4,359,609 | A | | 11/1982 | Apfel | 379/398 |
| 5,144,585 | A | | 9/1992 | Min et al. | 365/226 |
| 5,442,345 | A | * | 8/1995 | Kwon | 340/7.37 |
| 5,465,039 | A | | 11/1995 | Narita et al. | 320/32 |
| 5,783,935 | A | | 7/1998 | Kyung | 323/313 |
| 5,907,283 | A | * | 5/1999 | Kim | 340/661 |
| 6,111,394 | A | * | 8/2000 | Casper | 323/273 |
| 6,157,178 | A | * | 12/2000 | Montanari | 323/273 |
| 6,211,661 | B1 | | 4/2001 | Eckhardt | 323/316 |
| 6,465,999 | B2 | | 10/2002 | D'Angelo | 323/316 |
| 6,559,627 | B2 | * | 5/2003 | Khouri et al. | 323/282 |
| 6,642,631 | B1 | * | 11/2003 | Clavette | 307/52 |

* cited by examiner

*Primary Examiner*—Bao Q. Vu
(74) *Attorney, Agent, or Firm*—Dorsey & Whitney LLP

(57) ABSTRACT

An apparatus and method for compensating for a decreasing internal voltage that is generated from a higher external voltage. In response to the internal voltage decreasing in excess of a voltage margin, the amount by which the higher external voltage is reduced in generating the internal voltage is adjusted to raise the internal voltage.

6 Claims, 6 Drawing Sheets

VOLTAGE CONVERTER SYSTEM AND METHOD HAVING A STABLE OUTPUT VOLTAGE

CROSS-REFERENCE TO RELATED APPLICATION

This application is a divisional of U.S. patent application Ser. No. 10/076,982, filed Feb. 15, 2002 now U.S. Pat. No. 6,593,726.

TECHNICAL FIELD

The present invention is related generally to the field of electronic semiconductor devices, and more particularly, to voltage converter circuitry included therein for generating a relatively stable output voltage.

BACKGROUND OF THE INVENTION

Many semiconductor devices are designed to operate at various supply voltages and signal voltages. To accommodate the use of different supply voltages, the semiconductor device is typically designed to operate at the lower supply voltage. The lower supply voltage is often generated by including a voltage converter that steps-down the voltage of a higher external voltage level to a lower internal voltage level that is provided by an internal power supply. Thus, the device will be able to function whether the voltage of the external supply is greater than or equal to the voltage of the internal voltage supply. However, an issue that exists for any internal power supply of a device, both for devices that can operate at multiple supply voltage levels as well those that cannot, is whether the internal power supply has sufficient current drive capabilities.

A common occurrence that challenges the drive capabilities of an internal supply occurs when a device becomes active from a stand-by mode. Many devices are designed to automatically enter into a stand-by mode where power consumption is reduced to a minimum when the device is not currently in use. However, when the device becomes active again, the current loading often increases suddenly, placing a severe current load on the internal power supply. In some instances, the current loading of the internal power supply is so sudden that it causes the voltage of the internal power supply to drop-off. In severe cases, the voltage drop-off may be great enough to cause the device to malfunction.

Many different approaches have been taken in response to the current loading issue. One such approach is to simply design an internal power supply having greater current drive capabilities. However, although this is simple in principle, the implementation of such often poses several challenges. Another issue is the amount of space required to include an internal power supply having greater current drive capabilities. Where miniaturization is a priority in the design of the device, including an internal power supply having adequate current drive capabilities, but takes up more space, may not be an acceptable alternative. Another approach taken has been to accept increased power consumption in a stand-by state to reduce the current load when the device returns to an active mode. However, this alternative is undesirable because, as previously mentioned, it is generally desirable to design devices that are power efficient. Therefore, there is a need for a voltage converter that can provide a relatively stable output voltage in spite of sudden increases in current loading on the output.

SUMMARY OF THE INVENTION

The present invention is directed to an apparatus and method for compensating for a decreasing internal voltage that is generated from a higher external voltage. In response to the internal voltage decreasing in excess of a voltage margin, the amount by which the higher external voltage is reduced in generating the internal voltage is adjusted. The internal voltage is generated by a voltage conversion circuit having an input node to which the higher external voltage is applied, an output node at which the lower internal voltage is provided, and a control node to which a control signal having a control voltage is applied. The voltage conversion circuit generates an internal voltage having a voltage relative to the higher external voltage based on the voltage of the control signal. A compensation circuit is coupled to the voltage conversion circuit and includes a sense node coupled to the output node of the voltage conversion circuit, a supply node coupled to the input node of the voltage conversion circuit, and a feedback node coupled to the control node of the voltage conversion circuit. The compensation circuit generates a feedback signal at the feedback node to compensate for a decrease in the output voltage in response to the voltage of the output voltage falling below the voltage margin.

DETAILED DESCRIPTION OF THE INVENTION

Embodiments of the present invention are directed to a voltage converter providing a relatively stable output voltage despite increasing current loads on the output signal. Certain details are set forth below to provide a sufficient understanding of the invention. However, it will be clear to one skilled in the art that the invention may be practiced without these particular details. In other instances, well-known circuits, control signals, and timing protocols have not been shown in detail in order to avoid unnecessarily obscuring the invention.

Figure 1A:
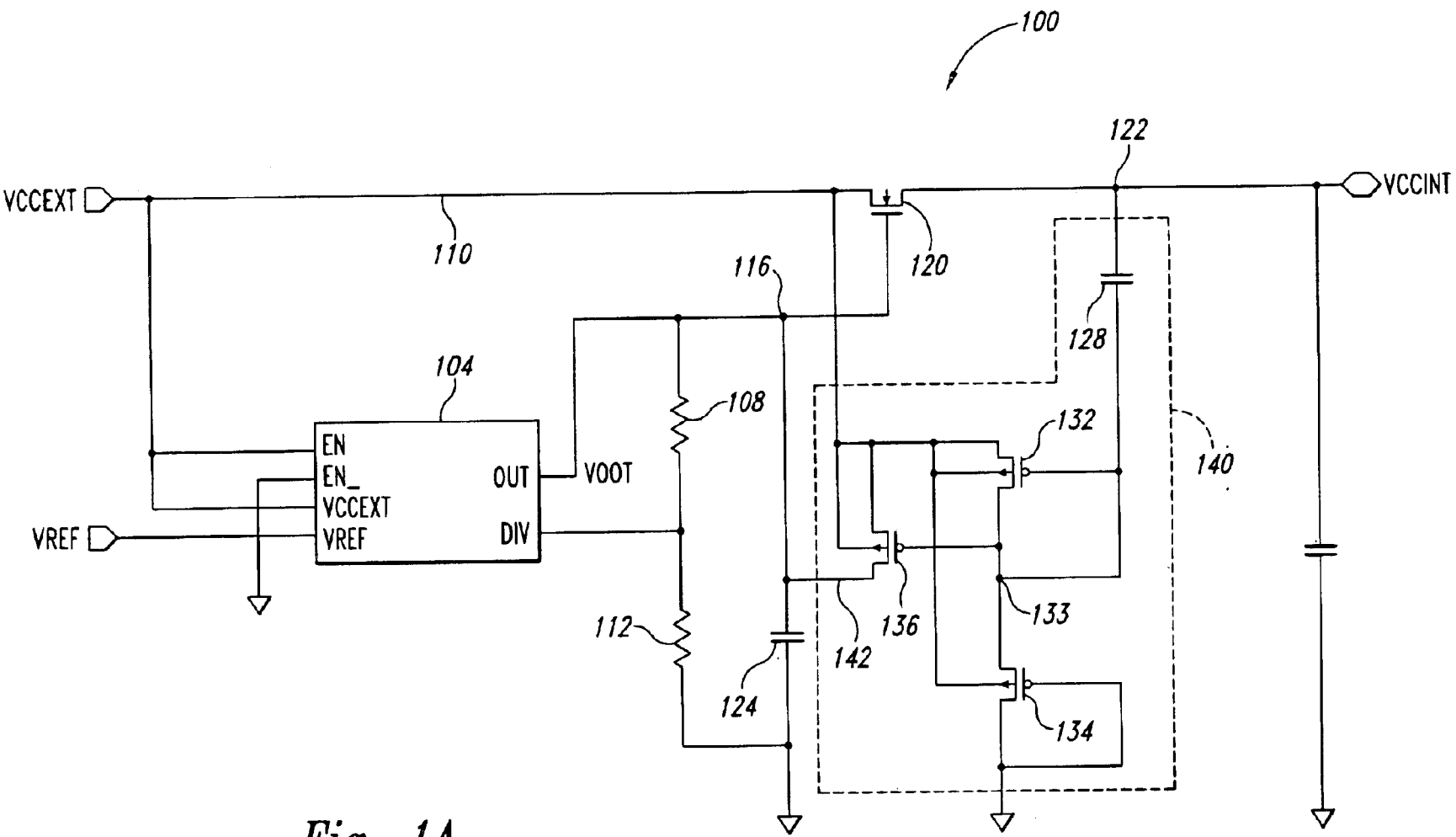
FIG. 1A is a schematic drawing of a voltage converter according to an embodiment of the present invention and FIG. 1B is a schematic drawing of a feedback circuit according to an alternative embodiment of present invention.

FIG. 1A illustrates a voltage converter 100 according to an embodiment of the present invention. The voltage converter 100 includes a differential amplifier 104 in which an output signal VOUT is generated from an external voltage VCCEXT, and will have a voltage level based on a reference voltage VREF and a feedback voltage VDIV. Generation of the VREF signal is made through a reference voltage generator (not shown) and is typically supplied to various circuitry within a memory device. Such reference voltage generators are known by those of ordinary skill in the art, and can be implemented using conventional circuitry. As illustrated in FIG. 1A, the VOUT signal is provided at a node 116 and fed back to the differential amplifier 104 through the use of a voltage divider circuit including resistors 108 and 112. The VOUT signal is provided to the gate of a transistor 120, which is used as a voltage controlled impedance to step-down the voltage of VCCEXT for a internal voltage supply at an output node 122 having an internal voltage VCCINT. A capacitor 124 is coupled to the gate of the transistor 120 and ground to reduce fluctuations in the VOUT signal. As will be described in more detail below, the capacitor 124 is also used by a feedback circuit 140 to reduce voltage drop-off of the VCCINT voltage when the current load on the internal voltage supply rapidly increases.

The feedback circuit 140 is coupled to the output node 122 and a node 110 at which the VCCEXT voltage is provided. An output 142 of the feedback circuit 140 is coupled to the node 116 at which the gate of the transistor 120 and the capacitor 124 are coupled as well. As shown in FIG. 1A, the feedback circuit 140 includes a diode-coupled transistor 132 having a gate coupled to the output node 122 through a capacitor 128. A second diode-coupled transistor 134 is coupled to the drain of the transistor 132 to form a voltage dividing circuit with the transistor 132. The second diode-coupled transistor 134 can be a p-type transistor, as shown, or an n-type transistor coupled as a diode, or a resistor, which serves the same biasing purpose. It will be appreciated that it is advantageous to have both the transistors 132 and 134 highly resistive to minimize power consumption by the voltage converter 100 and to increase the compensation efficiency of the feedback circuit 140 by making the coupling of capacitor 128 more effective. That is, having transistors 132 and 134 highly resistive will minimize the current drain from the node 110, to which the VCCEXT voltage is applied, to ground. At the same time, the highly resistive transistor 132 will improve the decoupling between the node 110 and node 133, so that the node 133 will follow the node 122 in its voltage behavior without influence from the node 110. A transistor 136 is coupled between the node 110 and the node 116 to provide a conductive path through which the VCCEXT voltage can be coupled to the capacitor 124 and the gate of the transistor 120. The gate of the transistor 136 is coupled to the voltage dividing circuit of transistors 132 and 134 to bias the gate of the transistor 136 such that when the VCCINT voltage drops-off below a trigger voltage, the transistor 136 becomes conductive. That is, feedback is provided by the feedback circuit 140 when the VCCINT voltage decreases in excess of a voltage difference defined by the trigger voltage.

Figure 1B:
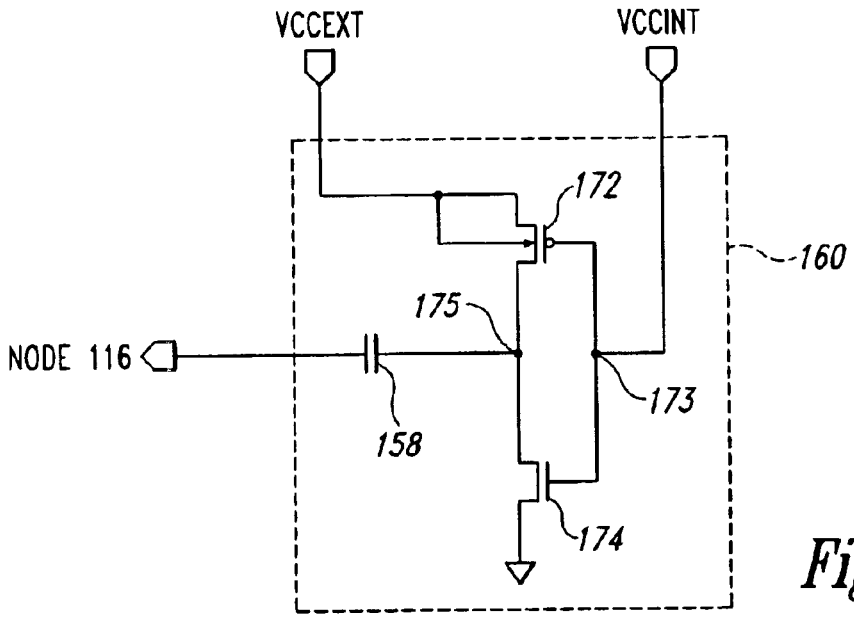

Illustrated in FIG. 1B is an alternative feedback circuit 160 that can be substituted for the feedback circuit 140 shown in FIG. 1A. The feedback circuit 160 includes an inverter formed by p-type and n-type transistors 172 and 174, respectively, coupled between the VCCEXT voltage at the node 110 and ground. The inverter of transistors 172, 174 has an input node 173 coupled directly to the node 122 at which VCCINT is provided. The inverter further has an output 175 coupled to the node 116 through a capacitor 158. The feedback circuit 160 provides negative feedback when the voltage of VCCINT decreases, causing the transistor 172 to become more conductive and the transistor 174 to be less conductive. Consequently, the voltage at the inverter output 175 will increase, thereby increasing the voltage of the node 116 through the capacitor 158.

Figure 2:
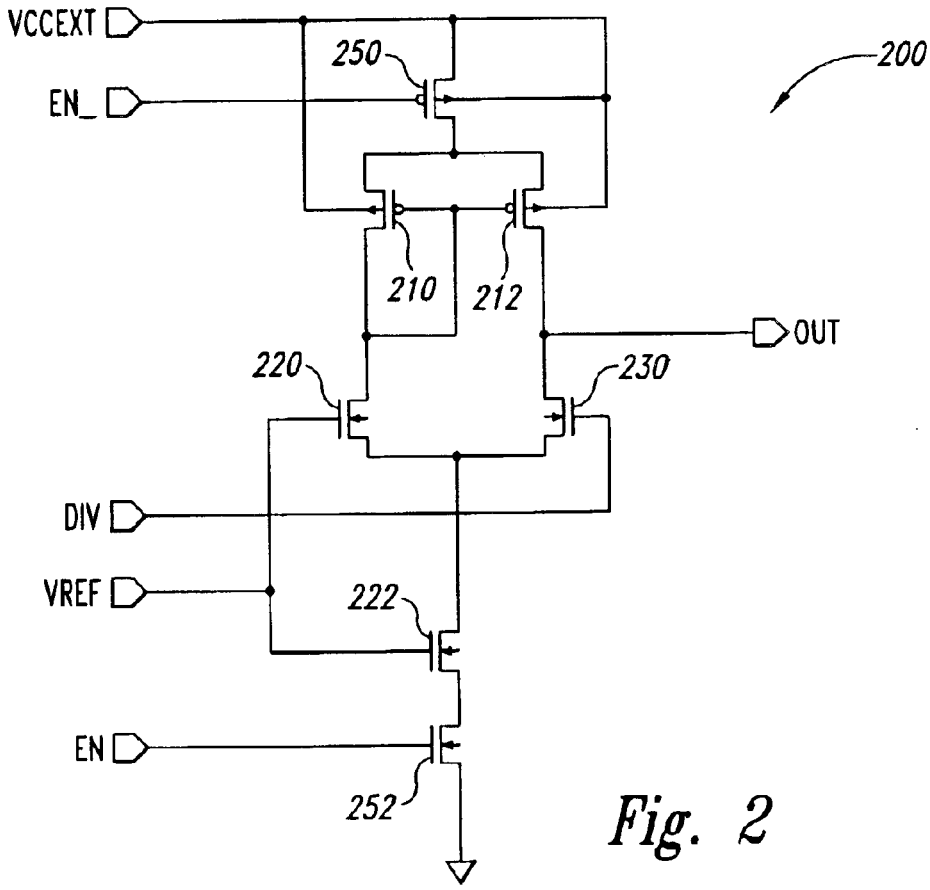
FIG. 2 is a schematic drawing of a differential amplifier that can be used in the voltage converter of FIG. 1A.

Illustrated in FIG. 2 is a differential amplifier 200 that can be substituted for the differential amplifier 104 shown in FIG. 1A. The VCCEXT voltage is used as a supply voltage from which VOUT signal is generated. Load transistors 210 and 212 are coupled to the VCCEXT voltage, and the gates of the input transistors 220, 222 and 230 each receive a respective input signal, namely, the VREF and VDIV voltages, that are used to adjust the voltage of the VOUT signal. In the configuration shown in the voltage converter 100 (FIG. 1A), the VDIV voltage is at a relatively constant voltage below the VOUT signal, and the VREF voltage is also a relatively constant voltage that, as previously mentioned, is provided by a reference voltage generator (not shown). Transistors 250 and 252 form an enable circuit that allows the differential amplifier to operate when an enable signal EN is active. As shown in FIG. 2, the EN signal is an active HIGH signal. The EN signal is applied to the gate of the transistor 252 and an inverted enable signal EN_ is applied to the gate of the transistor 250. Generation of such enable signals is well known in the art, and will not be discussed in greater detail in the interest of brevity.

Figure 3:
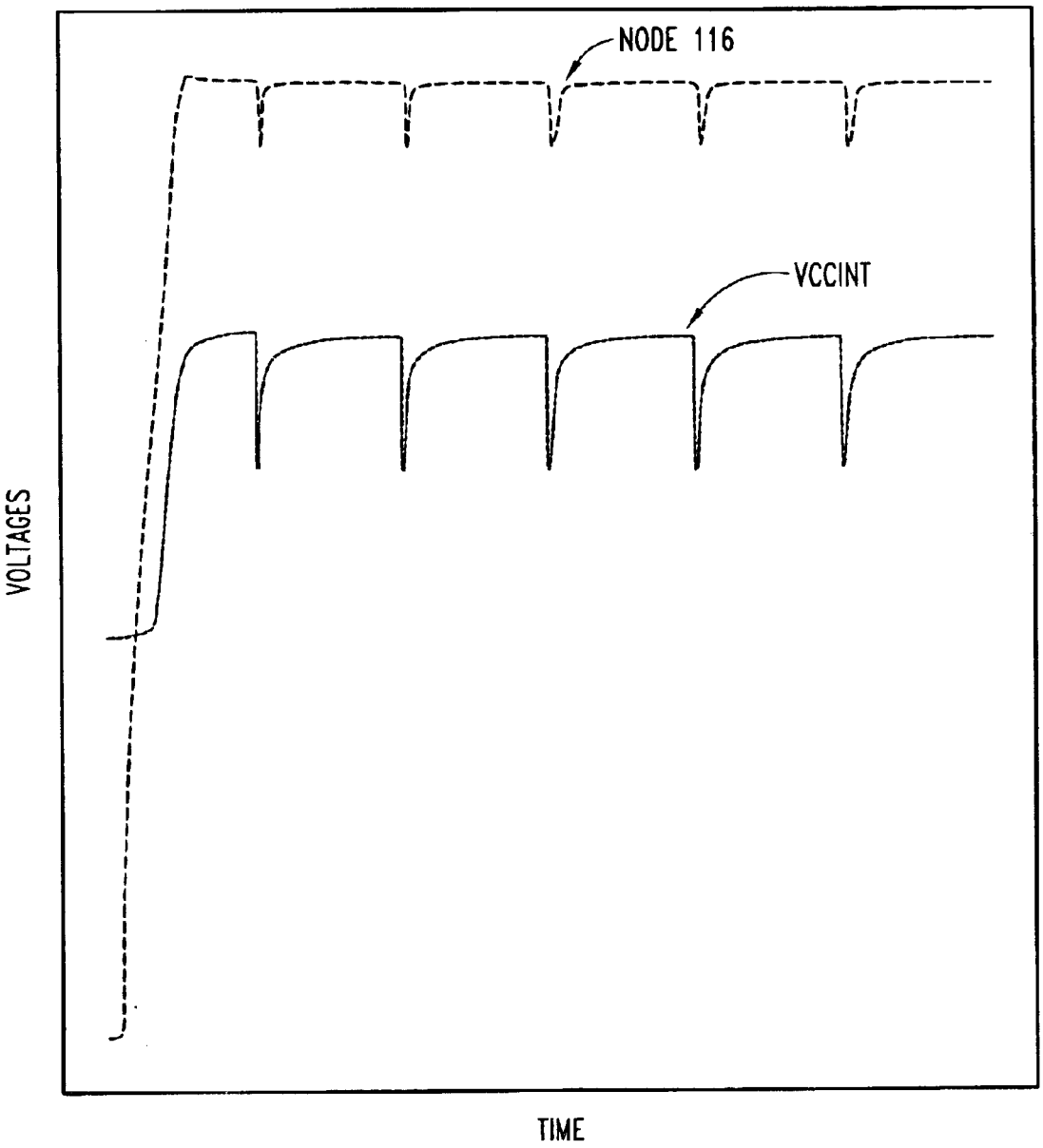
FIG. 3 is a signal diagram of various voltage signals of the voltage converter of FIG. 1A without a feedback circuit.

The operation of the voltage converter 100 will be initially described as operating without the benefit of the feedback circuit 140 in order to illustrate the benefits that the feedback circuit 140 provide to the voltage converter 100. Without the assistance of the feedback circuit 140, the drop-off in the VCCINT voltage can be quite dramatic where the current load on the internal voltage supply increases rapidly. As previously mentioned, this can occur when a memory device is activated from a stand-by state. In some instances, the current load can suddenly increase from approximately 100 $\mu$A in stand-by state to approximately 200 mA in an active state. The sudden increased current at the output node 122 causes the voltage drop across the transistor 120 to suddenly increase as well. Consequently, the increasing current load on the internal voltage supply causes the VCCINT voltage to drop-off until the voltage applied to the gate of the transistor 120 can increase to compensate for the increased current load. Due to parasitic source-gate capacitance of the transistor 120, the decrease in the VCCINT voltage also causes the gate voltage of the transistor 120 to decrease as well. This phenomena is commonly referred to as the Miller capacitance effect. The decrease in the gate voltage of the transistor 120 exacerbates the drop-off in the VCCINT voltage because the decreasing gate voltage causes the transistor 120 to become more resistive, and consequently, the VCCINT voltage to drop-off even more. As illustrated in the signal diagram of FIG. 3, the result is that the VCCINT voltage can drop-off by as much as 600 mV before the internal voltage supply can be charged back to a stable VCCINT voltage. As previously mentioned, where circuitry relies on the internal voltage supply, the dramatic drop-off in the VCCINT voltage may cause those circuits to malfunction.

As previously discussed, the Miller capacitance between the source of the transistor 120, which is coupled to the output node 122, and the gate of the transistor, which is coupled to the node 116, exacerbates the reduction in the VCCINT voltage when the current load on the internal voltage supply rapidly increases. In operation, the feedback circuit 140 couples the node 110 to the node 116 in order to use the VCCEXT voltage to drive the gate of the transistor 120 in response to a drop-off in the VCCINT voltage that exceeds a voltage difference. Thus, because the source to gate (Miller) capacitance is an internal capacitance that cannot be decoupled, a drop-off in the VCCINT voltage is fed back to the feedback circuit 140, which uses the VCCEXT voltage to drive the gate of the transistor 120 to be more conductive, and consequently, provide more current drive capability to the output node 122 when needed. In effect, the feedback circuit 140 (and the feedback circuit 160 of FIG. 1B) provides negative feedback to compensate for the Miller capacitance effect inherent in the transistor 120, or in other words, the drop-off exceeding a voltage difference in the VCCINT voltage is inverted and coupled to the gate of the transistor 120 to decrease its impedance.

Figure 4:
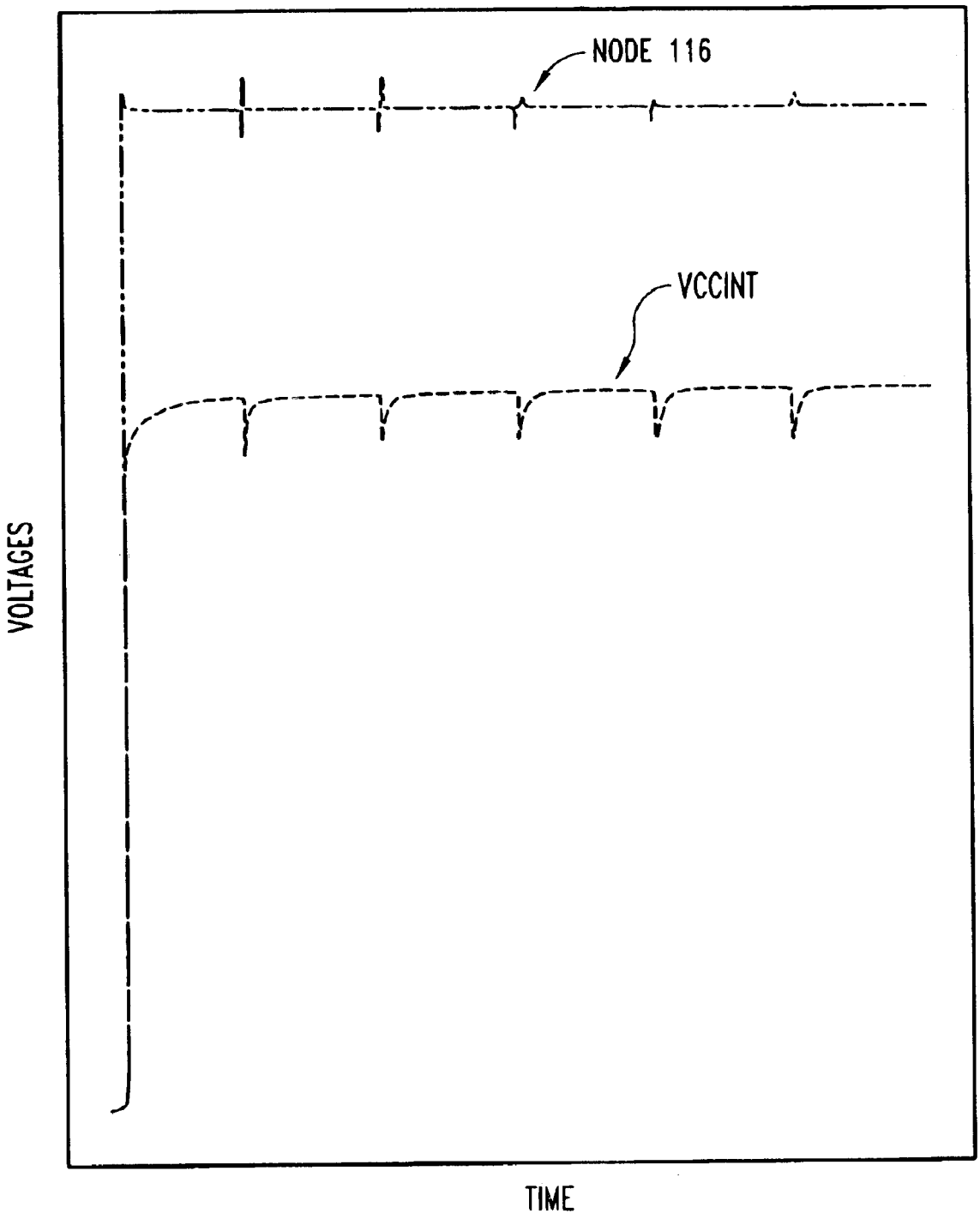
FIG. 4 is a signal diagram of various voltage signals of the voltage converter of FIG. 1A with a feedback circuit according to an embodiment of the present invention.

FIG. 4 illustrates a signal diagram that shows the improvement in the stability of the VCCINT voltage that is provided by the feedback circuit 140. With the benefit of the feedback circuit 140, the drop-off in the VCCINT voltage can be reduced to approximately 350 mV.

It will be appreciated that the feedback circuit 140 provides minimum feedback delay which enables very good compensation for the Miller capacitance. The feedback circuit 140 can be made very responsive because in that particular embodiment only the transistor 136 needs to be switched ON to couple the VCCEXT voltage to drive the gate of the transistor 120. Moreover, there is low DC current consumption through the resistive current paths, namely, from the node 116 to ground through resistors 108 and 112, and from the node 110 to ground through transistors 132 and 134. It will further be appreciated that the embodiment of the feedback circuit shown in FIG. 1A is activated only when compensation is needed, that is, when the VCCINT voltage drops-off. In the situation that the VCCINT voltage were to increase, the transistor 136 would remain OFF, and no compensation from the VCCEXT voltage would be provided. Thus, the feedback circuit 140 is limited to providing negative feedback.

As will be discussed below, the level of voltage drop-off or voltage difference before coupling of the node 110 to the node 116 occurs can be tailored to accommodate different levels of responsiveness. It will be appreciated that using the transistor 134 to set the bias point of the gates of transistors 132 and 136 through the transistor 134 can be used to adjust the amount of voltage drop-off before the feedback circuit 140 begins to couple the node 110 to the node 116. That is, the bias level to which the gate of the transistor 136 can be used to set the responsiveness of the feedback circuit 140.

For example, in one embodiment of the voltage converter 100, the characteristics of the transistor 134 are selected to bias the gate and drain of the transistor 132 such that the transistor is barely conductive. That is, the source-to-gate voltage of the transistor 132 will be slightly greater than the threshold voltage of the transistor 132, $V_{tp,132}$. The characteristics of the transistor 136 are selected such that when the transistor 132 is biased such that it is barely conducting, the transistor 136 is barely non-conductive. That is, the source-to-gate voltage of the transistor 136 will be slightly less than its threshold voltage, $V_{tp,136}$. In this condition, a relatively minor drop-off in the VCCINT voltage will cause the transistor 136 to begin conducting. As a result, the VCCEXT voltage can be quickly coupled to the node 116 to help maintain the charge on the capacitor 124 and drive the gate of the transistor 120 so that it is less resistive, and the VCCEXT voltage can be used to provide additional current drive capability to the internal voltage supply. Alternatively, in another embodiment, the characteristics of the transistors of the feedback circuit 140 are selected such that the gate of the transistor 136 is biased to near $V_{tp,136}$, but not to the same degree as in the previous example. Although relaxing the bias point of the gate of the transistor 136 will result in the feedback circuit 140 being less responsive, minor variations in the voltage of the VCCINT voltage will be filtered. In some instances, this may be desirable.

The responsiveness of the feedback circuit 140 can be altered through other means in addition to those previously discussed. For example, the capacitance of the capacitor 128 can be selected to incorporate limited filtering of minor variations in the VCCINT voltage. Alternatively, changing the capacitance of the capacitor 124 can be used to change the responsiveness of the feedback circuit 140 as well. It will be appreciated that implementing modifications to adjust the responsiveness of the feedback circuit 140 are within the understanding of those of ordinary skill in the art, and additionally, such modifications remain within the scope of the present invention. Moreover, the size of the transistor 136 and the capacitor 128 (and the capacitor 158 in FIG. 1B) will affect the level or amount of compensation provided by the feedback circuit 140. It will be appreciated that those of ordinary skill in the art have sufficient knowledge to select the size of the transistor 136 and capacitor 128 to be optimized to counteract the Miller capacitance effect inherent in the transistor 120.

Figure 5:
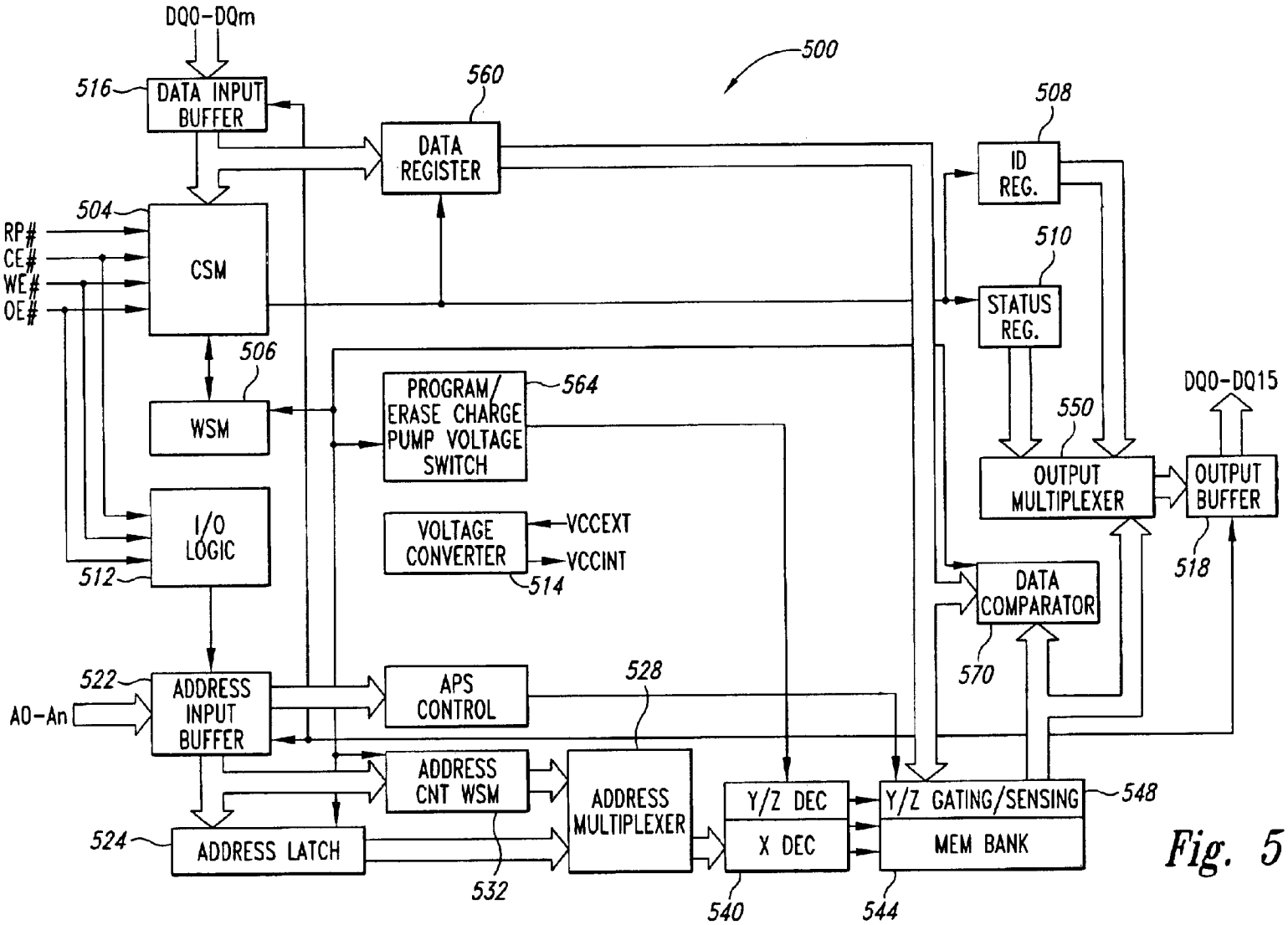
FIG. 5 is a block diagram of a memory device including a voltage converter according to an embodiment of the present invention.

FIG. 5 illustrates a non-volatile memory device 500 including a voltage converter 514 according to an embodiment of the present invention incorporated therein. The voltage converter receives an external voltage VCCEXT, and converts the VCCEXT voltage to an internal voltage VCCINT, which is used throughout the memory device 500. Commands are issued to a command state machine (CSM) 504 which acts as an interface between the an external processor (not shown) and an internal write state machine (WSM) 508. When a specific command is issued to the CSM 504, internal command signals are provided to the WSM 508, which in turn, executes the appropriate algorithm to generate the necessary timing signals to control the memory device 500 internally, and accomplish the requested operation. The CSM 504 also provides the internal command signals to an ID register 508 and a status register 510, which allows the progress of various operations to be monitored when interrogated by issuing to the CSM 504 the appropriate command.

Portions of the commands are also provided to input/output (I/O) logic 512 which, in response to a read or write command, enables the data input buffer 516 and the output buffer 518, respectively. The I/O logic 512 also provides signals to the address input buffer 522 in order for address signals to be latched by an address latch 524. The latched address signals are in turn provided by the address latch 524 to an address multiplexer 528 under the command of the WSM 506. The address multiplexer 528 selects between the address signals provided by the address latch 524 and those provided by an address counter 532. The address signals provided by the address multiplexer 528 are used by an address decoder 540 to access the memory cells of a memory bank 544 that correspond to the address signals. A gating/sensing circuit 548 is coupled to the memory bank 544 for the purpose of programming and erase operations, as well as for read operations.

During a read operation, data is sensed by the gating/sensing circuit 548 and amplified to sufficient voltage levels before being provided to an output multiplexer 550. The read operation is completed when the WSM 506 instructs the output buffer 518 to latch data provided from the output multiplexer 550 to be provided to the extern processor. The output multiplexer 550 can also select data from the ID and status registers 508, 510 to be provided to the output buffer 518 when instructed to do so by the WSM 506. During a program or erase operation, the I/O logic 512 commands the data input buffer 516 to provide the data signals to a data register 560 to be latched. The WSM 506 also issues commands to program/erase circuitry 564 which uses the address decoder 540 to carry out the process of injecting or removing electrons from the memory cells of the memory bank 544 to store the data provided by the data register 560 to the gating sensing circuit 548. To ensure that sufficient programming or erasing has been performed, a data comparator 570 is instructed by the WSM 506 to compare the state of the programmed or erased memory cells to the data latched by the data register 560.

It will be appreciated that the embodiment of the memory device 500 that is illustrated in FIG. 5 has been provided by way of example and that the present invention is not limited thereto. Those of ordinary skill in the art have sufficient understanding to modify the previously described memory device embodiment to implement embodiments of the voltage converter. For example, the voltage converter 514 is represented in FIG. 5 as a separate circuit block. However, the voltage converter 514 may be incorporated into one of the other circuit blocks, or alternatively, may be split among several circuit blocks. In other cases, a portion of the circuits of the memory device 500 can be powered by an external voltage supply while others are powered by an internal voltage supply such as that generated by the voltage converter 514. The particular arrangement of the voltage converter 514 within a memory device will be a matter of design preference. Additionally, although the voltage converter has been described as having an external voltage applied as the input and an internal voltage supply as the output, it will be appreciated that the voltage converter can convert voltage levels of other voltage supplies as well. Such types of modifications may be made without departing from the scope of the present invention.

Figure 6:
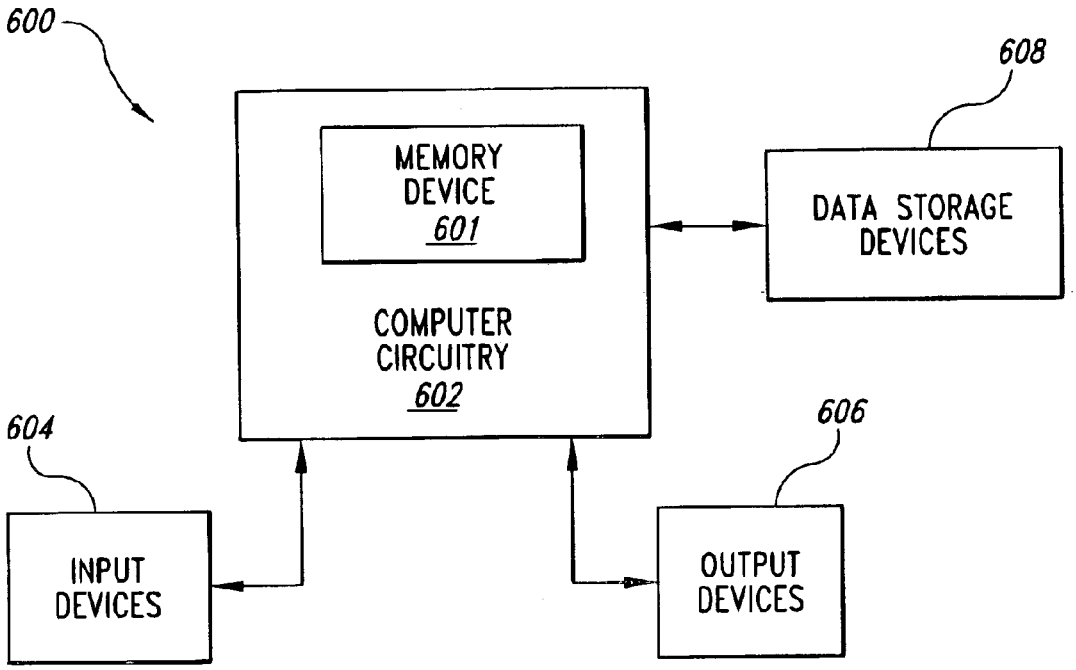
FIG. 6 is a block diagram of a computer system including the memory device of FIG. 5.

FIG. 6 is a block diagram of a computer system 600 including computing circuitry 602. The computing circuitry 602 contains a memory device 601 that includes a voltage converter according to an embodiment of the present invention. The computing circuitry 602 performs various computing functions, such as executing specific software to perform specific calculations or tasks. In addition, the computer system 600 includes one or more input devices 604, such as a keyboard or a mouse, coupled to the computer circuitry 602 to allow an operator to interface with the computer system. Typically, the computer system 600 also includes one or more output devices 606 coupled to the computer circuitry 602, such output devices typically being a printer or a video terminal. One or more data storage devices 608 are also typically coupled to the computer circuitry 602 to store data or retrieve data from external storage media (not shown). Examples of typical storage devices 608 include hard and floppy disks, tape cassettes, and compact disc read-only memories (CD-ROMs). The computer circuitry 602 is typically coupled to the memory device 601 through appropriate address, data, and control busses to provide for writing data to and reading data from the memory device 601.

From the foregoing it will be appreciated that, although specific embodiments of the invention have been described herein for purposes of illustration, various modifications may be made without deviating from the spirit and scope of the invention. Accordingly, the invention is not limited except as by the appended claims.

It is claimed:

1. A memory device, comprising:

an address bus;

a control bus;

a data bus;

an address decoder coupled to the address bus;

a read/write circuit coupled to the data bus;

a memory-cell array coupled to the address decoder, control circuit, and read/write circuit; and a voltage converter for converting a first voltage to an output voltage, the output voltage having a lower voltage than the first voltage and used internally to the memory device, the voltage converter comprising:

a voltage conversion circuit having an input node to which the first voltage is provided, an output node at which the output voltage is provided, and a control node to which a control signal having a control voltage is provided, the voltage conversion circuit generating an output voltage having a voltage relative to the first voltage based on the voltage of the control signal; and a feedback circuit having it sense node coupled to the output node, a supply node coupled to the input node, and a feedback node coupled to the control node, the feedback circuit generating a feedback signal at the feedback node to compensate for a decrease in the output voltage in response to the voltage of the output voltage falling below a trigger voltage.

2. The memory device of claim 1 wherein the feedback circuit of the voltage converter comprises a switch having a control terminal coupled to the output node, the switch coupling the first voltage of the input node to the control node in response to the voltage of the output voltage falling below the trigger voltage.

3. The memory device of claim 2 wherein the feedback circuit further comprises a voltage divider circuit coupled to the supply node and ground, the voltage divider circuit having a bias node coupled to the control terminal of the switch and the output node to maintain a bias on the control terminal of the switch to isolate the input node and the control node of the voltage conversion circuit until the voltage of the output voltage falls below the trigger voltage.

4. The memory device of claim 3 wherein the voltage divider circuit comprises active load elements.

5. The memory device of claim 1 wherein the voltage converter further comprises a capacitor having a first node coupled to the output node of the voltage conversion circuit and a second node coupled to the sense node of the feedback circuit.

6. The memory device of claim 1 wherein the voltage converter further comprises a control circuit for generating a control signal for the voltage conversion circuit, the control circuit having a supply terminal coupled to the input node, a first reference voltage terminal to which a reference voltage is applied, an output terminal coupled to the control node of the voltage conversion circuit, and a second reference voltage terminal coupled to the output terminal, the control circuit generating an output signal from the first voltage having a voltage based on the reference voltage and the output signal.

* * * * *